US008616796B2

(12) United States Patent
Lobl

(10) Patent No.: US 8,616,796 B2
(45) Date of Patent: Dec. 31, 2013

(54) DUAL PURPOSE TOILET BRUSH

(76) Inventor: Naftali Lobl, Ramat Gan (IL)

( * ) Notice: Subject to any disclaimer, the term of this patent is extended or adjusted under 35 U.S.C. 154(b) by 520 days.

(21) Appl. No.: 12/705,606

(22) Filed: Feb. 14, 2010

(65) Prior Publication Data

US 2011/0197383 A1 Aug. 18, 2011

(51) Int. Cl.
*A46B 11/00* (2006.01)

(52) U.S. Cl.
USPC ..... 401/131; 401/268; 4/231

(58) Field of Classification Search
USPC ..... 401/131, 268, 6; 4/222, 231, 232; 15/104.94, 210.1, 160; 422/5, 266, 275
See application file for complete search history.

(56) References Cited

U.S. PATENT DOCUMENTS

| | | | | | |
|---|---|---|---|---|---|
| 1,880,912 | A * | 10/1932 | Duwelius | 4/231 |
| 4,261,957 | A * | 4/1981 | Schimanski | 422/263 |
| 5,572,761 | A * | 11/1996 | Meyer | 15/21.2 |
| 5,769,383 | A * | 6/1998 | Hemler | 248/682 |
| 7,854,034 | B2 * | 12/2010 | Welsh | 15/143.1 |

* cited by examiner

*Primary Examiner* — David Walczak

(57) ABSTRACT

A household device. One household device comprises a rod and a chamber extending from the rod, the chamber is configured to contain one dispensing element, the one dispensing element is configured for dispensing materials that are dissolvable in water. The chamber further includes at least one opening configured to allow the dispensing material to contact water and thereby dispense the dispensing material when in contact with water. The household device additionally includes one mounting clip attached to at least one of the rod and the chamber. The mounting clip is configured for mounting the rod and chamber to a household implement that periodically fills with water.

7 Claims, 3 Drawing Sheets

DUAL PURPOSE TOILET BRUSH

BACKGROUND

1. Technical Field

The present invention relates to the field of toilet accessories and, more particularly, to toilet accessories that sanitize a bathroom implement.

2. Discussion of Related Art

Toilet bowls require care to prevent the buildup of unsightly deposits and to reduce odors.

Traditionally, toilet bowls have been cleaned by manual scrubbing with a brush to reduce deposits.

U.S. Pat. No. 3,361,507, which is hereby incorporated herein as if fully enclosed herein, teaches a brush and holder assembly.

In addition to manual scrubbing, to reduce odors, various toilet bowl cleaner dispensers have been proposed. One type of dispenser comprises a solid block or solid particles of a cleansing and freshening substance that is suspended from the rim of a toilet bowl in a container that is placed in the path of the flushing water.

U.S. Pat. No. 4,777,670, which is hereby incorporated herein as if fully enclosed herein, teaches a solid block that is partially dissolved in the flush water with each flush such that the flush water, including the dissolved portion of the solid block, is dispensed into the toilet bowl.

Additional background art includes: U.S. Pat. No. 4,211,750.

BRIEF SUMMARY

Embodiments of the present invention provide a household device. One device comprises a rod and a chamber extending from the rod, the chamber is configured to contain one dispensing element, the one dispensing element is configured for dispensing materials that are dissolvable in water.

The chamber further includes at least one opening configured to allow the dispensing material to contact water and thereby dispense the dispensing material when in contact with water.

Accordingly, according to an aspect of the present invention, a second component of the household device includes one mounting clip attached to at least one of the rod and the chamber. The mounting clip is configured for mounting the rod and chamber to a household implement that periodically fills with water.

These, additional, and/or other aspects and/or advantages of the present invention are set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
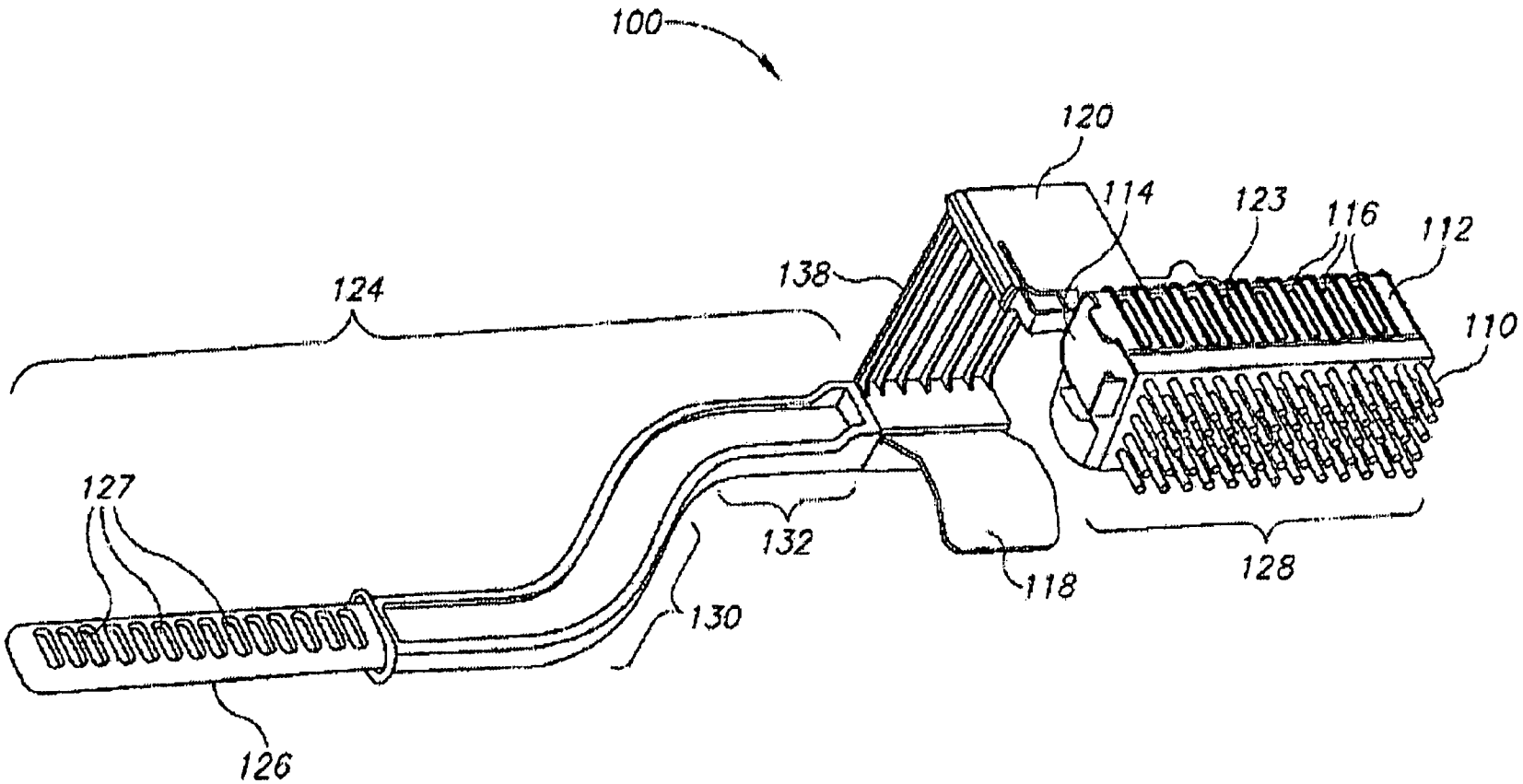
FIG. 1 shows a toilet brush, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 shows a dual brush 100, according to embodiments of the invention. Dual brush 100 includes a brush 110 utilized for cleaning a toilet bowl (not shown). Dual brush 100 includes a handle 124 attached to a detergent and/or deodorant dispenser 128, herein detergent dispenser 128. Brush 110 extends from detergent dispenser 128 and dual brush 100 is configured to clean a toilet bowl and dispense detergent and or a fragrance perfume to the toilet bowl.

Detergent dispenser 128 includes a compartment 112 which holds a dispenser 123 comprising, for example, a sponge that can hold a liquid such as a perfume and/or detergent that is dispensed upon contact with water in the toilet bowl as the water rises during flushing. The many materials from which dispenser 123 can be manufactured are well known to those familiar with the industry.

Compartment 112 includes compartment openings 116 that allow water to pass through compartment 112 and come in contact with a sponge 114 as the water rises in the toilet as noted above.

Compartment 112 is connected to a vertical support 120 which is configured to press against the inside of a toilet bowl as will be explained below. A horizontal connector 138 is connected to a vertical flexible clip 118, optionally with an intrinsic hinge. Vertical flexible clip 118 may be shaped such that it clings on the rim of the toilet bowl.

As used herein, the term "intrinsic hinge" defines a flexible device that allows the turning or pivoting of a part, on a stationary frame.

The position of vertical support 120 is substantially parallel to the longitudinal axis of flexible clip 118, so that in combination, vertical support 120, vertical flexible clip 118, and horizontal connector 138 allow dual brush 100 to be clipped in place around the upper rim of a toilet bowl as will be shown below.

According to some embodiments of the invention, vertical support 120 may be in operative associated with a ratchet (not shown) such that that the vertical support 120 is adapted to fit onto varying width of rims of toilet bowls.

While flexible clip 118 is shown as an extension of horizontal connector 138, wherein flexible clip 118 may be attached to horizontal connector 138 with a joint that is intrinsically springy. Alternatively flexible clip 118 may be attached to horizontal connector 138 with a hinge and a spring that provides pressure of flexible clip 118 against the toilet bowl.

Flexible clip 118 and vertical support 120 protrude from handle 124. Handle 124 includes multiple sections which facilitate attachment of dual brush 100 in a non-protruding partisan manner with respect to a toilet bowl. Handle 124 includes a clip support 132 which extends from clip 118. Extending from clip support 132 is a handle curvature 130 which allows a handle grasper 126 to unobtrusively be positioned below the toilet bowl.

Handle grasper 126 includes ferrets 127 that create friction between the hand of the consumer and dual brush 100 to facilitate grasping handle 124 while cleaning the toilet bowl with brush 110.

Figure 2:
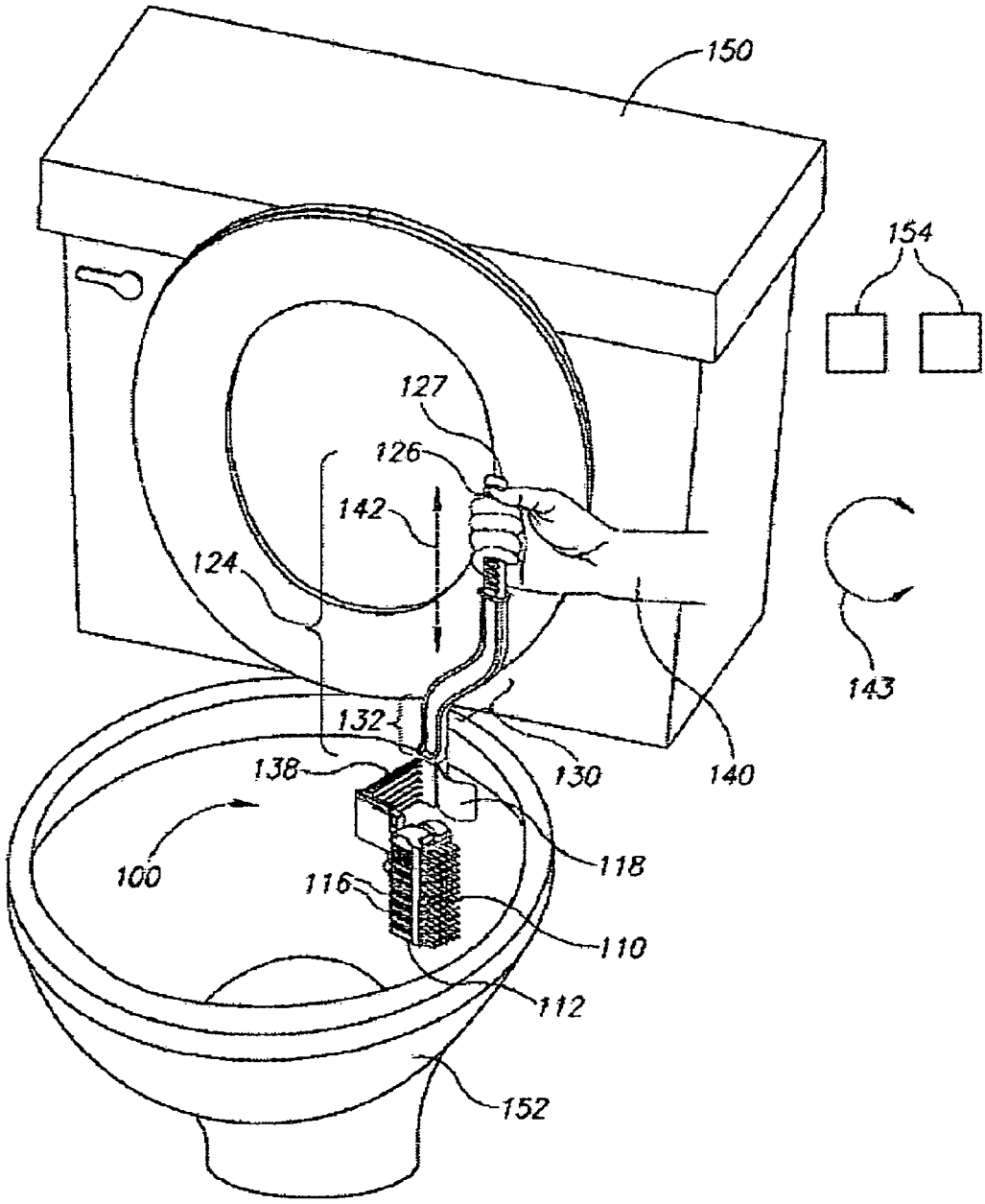
FIG. 2 shows operation of the toilet brush shown in FIG. 1, according to some embodiments of the invention.

FIG. 2 shows a toilet bowl 152 of a toilet 150 being cleaned with dual brush 100. Handle 124 is grasped by a human hand 140 and moved in directions up and down 142 thereby cleaning toilet bowl 152. While dual brush 100 is shown cleaning the inside of toilet bowl 152, dual brush may be utilized for cleaning other portions of toilet 150 and or porcelain tiles 154. The many means of utilizing dual brush 100 for cleaning are well known to those familiar with the art. Additionally, while dual brush 100 is shown being moved in directions 142, dual brush 100 may also be moved in a circular direction 143, and/or any other combination of directions that may be contemplated during cleaning of toilet bowl 152, and/or other above-noted cleaning processes.

Figure 3:
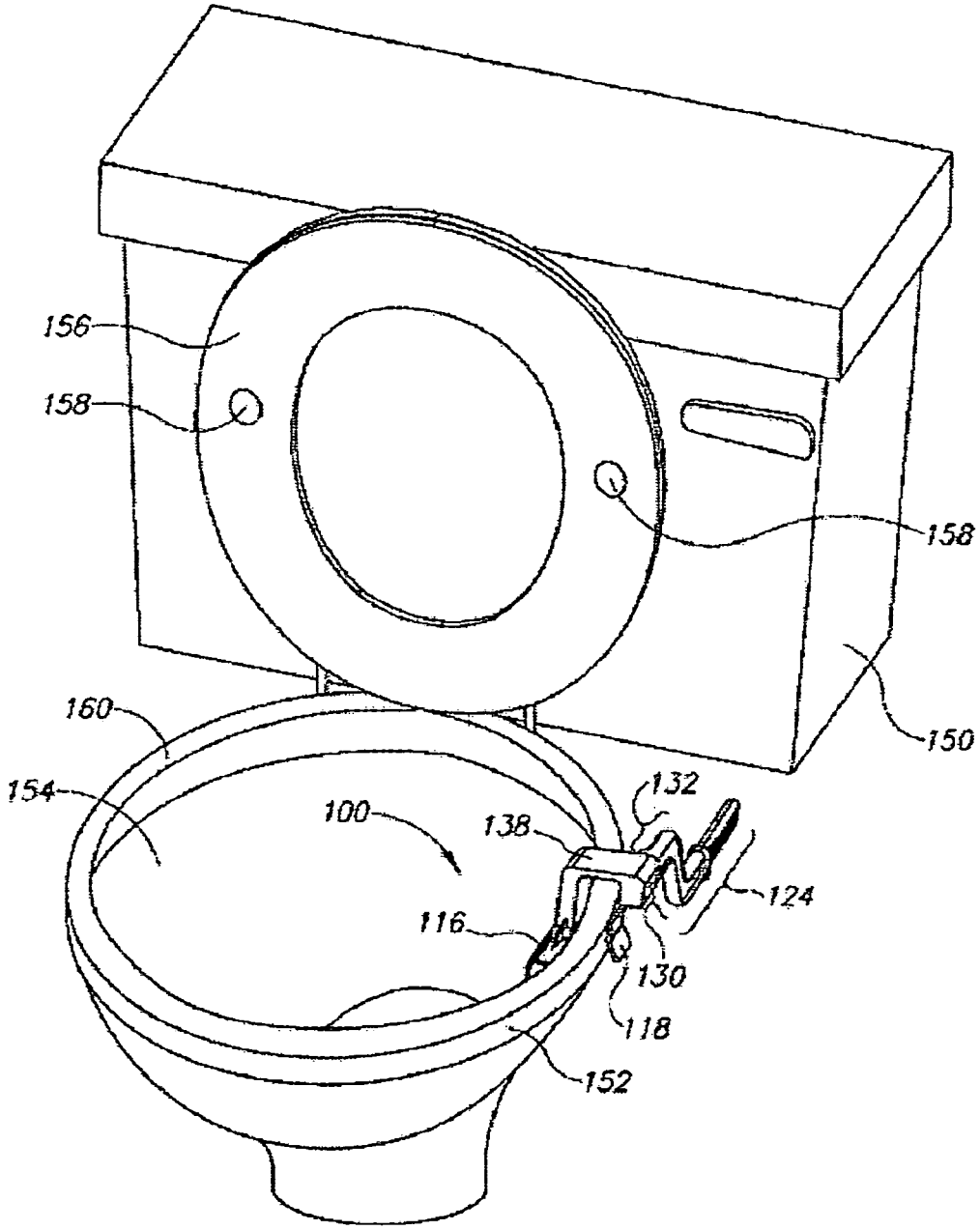
FIG. 3 shows a deodorization mode of utilizing the toilet brush shown in FIG. 1, according to some embodiments of the invention.

FIG. 3 shows dual brush 100 attached to toilet bowl 152 in the above-noted detergent and/or perfume dispensing mode, following the cleaning operation shown above in FIG. 2.

Compartment 112 is suspended inside of toilet bowl 152 so that as the water rises in the water bowl during flushing, as noted above, the detergent and/or deodorant held in compartment 112 is released, thereby reducing and/or removing odors as noted above.

Horizontal connector 138 spans across the upper edge of toilet bowl 152 while clip 118 and vertical support 120 extend around a toilet rim 160 to hold dual brush 100 in position on toilet bowl 152.

Additionally handle curve 130 serves to maintain handle grasper 126 below the level of toilet rim 160 and out of the way so that when a seat 156 is in the horizontal position there is no damage inflicted on handle grasper 126.

Furthermore, horizontal connector 138 barely protrudes above the surface of the upper rim 160 so that when toilet seat 156 is placed parallel with toilet rim 160, rubber stoppers 158 which are typically included on the underside of toilet seat 156, the space created by rubber stoppers 158 prevents toilet seat 156 from damaging dual brush 100.

In still further embodiments, brushes 110 are pointed vertically downward on the inside of toilet bowl 152, and below toilet rim 160, so that when toilet seat 156 is closed in the horizontal position over toilet rim 160, brushes 110 are not damaged.

In the above description, an embodiment is an example or implementation of the inventions. The various appearances of "one embodiment", "an embodiment", or "some embodiments", do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment", or "other embodiments", means that a particular feature, structure, or characteristic described in connection with the embodiments is included in at least some embodiments, but not necessarily all embodiments, of the inventions.

It is to be understood that the phraseology and terminology employed herein are not to be construed as limiting, and are for descriptive purposes only.

The principles and uses of the teachings of the present invention may be better understood with reference to the accompanying description, figures, and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting", and grammatical variants thereof do not preclude the addition of one or more components, features, steps, or integers; or groups thereof, and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques, and procedures by practitioners of the art to which the invention belongs.

The descriptions, examples, methods, and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A toilet-brush comprising:

a) a handle (124);

b) an horizontal connector (138);

c) vertical support (120);

d) a vertical flexible clip (118); and e) a brush (110) having brushing elements, wherein said brush extends from said vertical support;

wherein said vertical support and said vertical flexible clip are connected to and extend vertically from said horizontal connector, shaped to fit onto and accommodate a rim of a toilet bowl;

wherein when said connector is fit onto the rim of a toilet bowl, said horizontal connector is disposed adjacently to the rim of a toilet bowl and said handle is unobtrusively positioned substantially parallel to a longitudinal axis of the bowl and below the rim of the toilet bowl; and wherein said vertical support and said vertical flexible clip are configured to detachably attach the toilet-brush onto and embrace the rim of the toilet bowl.

2. The toilet-brush of claim 1 further comprising:

f) a detergent dispenser (128) having a compartment (112), wherein said detergent dispenser extends from said vertical support;

wherein said compartment is configured to contain a dispensing element (123);

wherein said dispensing element is configured for dispensing materials that are dissolvable in water, when said dispensing element is disposed inside said compartment; and wherein said compartment further includes at least one opening (116) configured to allow the dispensing material to contact water and thereby dispense the dispensing material when in contact with water.

3. The toilet-brush of claim 1, wherein said vertical flexible clip, is connected to said horizontal connector with a joint that is intrinsically springy.

4. The toilet-brush of claim 1, wherein said horizontal connector has a thickness configured to allow a space between the upper surface of said horizontal connector and the lower surface of a toilet seat, when the toilet seat is in a horizontal position.

5. The toilet-brush of claim 1, wherein said handle includes a handle grasper (126) configured for grasping by a human hand.

6. The toilet-brush of claim 1, wherein said handle includes a handle curve (130) having a curvature such that said handle is below the level of said horizontal connector when the toilet-brush is attached to a toilet bowl.

7. The toilet-brush of claim 1, wherein when said connector is fit onto the rim of a toilet bowl, the brushing elements said brush are pointing vertically downward on the inside of the toilet bowl, and below the rim of the toilet bowl, so that when the toilet seat is in the horizontal position over toilet the rim, said brushes of said brush are not damaged.

* * * * *